US011852422B2

(12) United States Patent
Mohanta et al.

(10) Patent No.: US 11,852,422 B2
(45) Date of Patent: Dec. 26, 2023

(54) DOUBLE WAVE FIN PLATE FOR HEAT EXCHANGER

(71) Applicant: CARRIER CORPORATION, Palm Beach Gardens, FL (US)

(72) Inventors: Lokanath Mohanta, Liverpool, NY (US); Arindom Joarder, Jamesville, NY (US); Jack Leon Esformes, Jamesville, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/255,881

(22) PCT Filed: Sep. 4, 2020

(86) PCT No.: PCT/US2020/049370
§ 371 (c)(1),
(2) Date: Dec. 23, 2020

(87) PCT Pub. No.: WO2021/046326
PCT Pub. Date: Mar. 11, 2021

(65) Prior Publication Data

US 2022/0307774 A1 Sep. 29, 2022

Related U.S. Application Data

(60) Provisional application No. 62/896,139, filed on Sep. 5, 2019.

(51) Int. Cl.
*F28F 1/32* (2006.01)
*F25B 39/00* (2006.01)

(52) U.S. Cl.
CPC ..... *F28F 1/325* (2013.01); *F25B 39/00* (2013.01)

(58) Field of Classification Search
CPC .... F28F 1/325; F28F 1/126; F28F 1/22; F28F 1/32; F28F 2215/00; F25B 39/00
See application file for complete search history.

(56) References Cited

U.S. PATENT DOCUMENTS

2013/0087318 A1* 4/2013 Nakano ..... F28F 1/126 165/181
2016/0123681 A1* 5/2016 Honma ..... F28F 1/32 165/181

FOREIGN PATENT DOCUMENTS

DE 496733 C 4/1930
EP 3018439 A1 5/2016
(Continued)

OTHER PUBLICATIONS

International Search Report; International Application No. PCT/US2020/049370; dated Sep. 4, 2020; dated Nov. 12, 2020; 5 pages.
(Continued)

*Primary Examiner* — Len Tran
*Assistant Examiner* — Kamran Tavakoldavani
(74) *Attorney, Agent, or Firm* — CANTOR COLBURN LLP

(57) ABSTRACT

Disclosed is a double wave fin plate for a fin-tube heat exchanger, having: one half-plate having one perimeter edge with one cut-out forming one portion of a tube connector; another half-plate having another perimeter edge with another cut-out forming another portion of the tube connector; the one perimeter edge and the other perimeter edge are connected to one another about each cut-out to form the fin plate and the tube connector; one surface waveform is formed on the one half-plate; another surface waveform is formed on the other half-plate, and the one surface waveform is disposed at an angle to the other surface waveform in the fin plate.

19 Claims, 5 Drawing Sheets

(56) References Cited

FOREIGN PATENT DOCUMENTS

| | | | |
|---|---|---|---|
| JP | 54140253 | A | 10/1979 |
| JP | 57104185 | U | 6/1982 |
| JP | 0626778 | A | 2/1994 |

OTHER PUBLICATIONS

Written Opinion; International Application No. PCT/US2020/049370; dated Sep. 4, 2020; dated Nov. 12, 2020; 9 pages.

* cited by examiner

DOUBLE WAVE FIN PLATE FOR HEAT EXCHANGER

CROSS REFERENCE TO RELATED APPLICATIONS

This application is a National Stage application of PCT/US2020/049370, filed Sep. 4, 2020, which claims the benefit of U.S. Provisional Application No. 62/896,139, filed Sep. 5, 2019, both of which are incorporated by reference in their entirety herein.

BACKGROUND

The disclosed embodiments relate to heat exchangers and more specifically to fin plates connected to tubes in heat exchangers.

In most evaporator and condenser applications with refrigerant-to-air heat transfer equipment, the airside convective resistance to heat transfer is dominant, at 75% or more of the total thermal resistance. To minimize this resistance finned surfaces are used. Wavy fin surface is one of such surfaces which have relatively higher frost tolerance. Air flow behind a tube may separate and result in a wake. The flow separation and wake contributes to a pressure drop and less efficient heat transfer.

BRIEF DESCRIPTION

Disclosed is a double wave fin plate for a fin-tube heat exchanger, comprising of: one half-plate having one perimeter edge with one cut-out forming one portion of a tube connector; another half-plate having another perimeter edge with another cut-out forming another portion of the tube connector; the one perimeter edge and the other perimeter edge are connected to one another about each cut-out to form the fin plate and the tube connector; one surface waveform is formed on the one half-plate; another surface waveform is formed on the other half-plate, and the one surface waveform is disposed at an angle to the other surface waveform in the fin plate.

In addition to one or more of the above disclosed aspects or as an alternate each half-plate is rectangular.

In addition to one or more of the above disclosed aspects or as an alternate each tube connector is circular.

In addition to one or more of the above disclosed aspects or as an alternate the one surface waveform is perpendicular to the other surface waveform in the fin plate.

In addition to one or more of the above disclosed aspects or as an alternate each surface waveform is sinusoidal, triangular, trapezoidal or corrugated.

In addition to one or more of the above disclosed aspects or as an alternate one peak or one trough from each surface waveform on each half-plate converges at a center of the tube connector.

In addition to one or more of the above disclosed aspects or as an alternate each of the surface waveforms is pitched so that each half-plate includes at least two peaks and two troughs.

In addition to one or more of the above disclosed aspects or as an alternate: a height of each of the peaks and each of the troughs of each of the surface waveforms is the same: and a distance between each of the peaks and each of the trough in each of the surface waveforms is the same.

In addition to one or more of the above disclosed aspects or as an alternate a fin plate seam is formed where the one perimeter edge and the other perimeter edge abut, and one end of the fin plate seam forms one of the peaks.

In addition to one or more of the above disclosed aspects or as an alternate another end of the fin plate seam forms one of the troughs.

In addition to one or more of the above disclosed aspects or as an alternate a peak-side edge of the fin plate is defined between one pair of corners of the fin plate that are adjacent the one end of the fin plate seam; and the one pair of corners are on ones of the peaks.

In addition to one or more of the above disclosed aspects or as an alternate a trough-side of the fin plate is defined between another pair of corners of the fin plate that are adjacent the other end of the fin plate seam: and the other pair of corners are on respective ones of the troughs.

A system is disclosed comprising a plurality of the fin plates having one or more of the above disclosed aspects arranged in a grid.

In addition to one or more of the above disclosed aspects or as an alternate the plurality of fin plates are arranged so that the trough-side edges of each of the fin plates is closer to one side of the system and the peak-side edge of each of the fin plates is closer to another side of the system.

In addition to one or more of the above disclosed aspects or as an alternate the plurality of the fin plates are arranged in an in-line grid, with ones of the fin plates distributed among a plurality of rows that are mutually parallel, and a plurality of columns that are mutually parallel, wherein the plurality of rows and the plurality of columns are mutually perpendicular.

In addition to one or more of the above disclosed aspects or as an alternate the plurality of the fin plates are arranged on a diagonal grid with ones of the fin plates distributed among a plurality of rows that are mutually parallel, and a plurality of columns that are mutually parallel, wherein the plurality of columns are angled relative to the plurality of rows.

In addition to one or more of the above disclosed aspects or as an alternate a fin plate seam of one fin plate is aligned with an outside edge of another fin plate.

In addition to one or more of the above disclosed aspects or as an alternate the system includes a plurality of tubes distributed among the plurality of fin plates.

Further disclosed is a method of directing gas flow over a fin plate that surrounds a tube, comprising directing gas flow over a plurality of surface waveforms formed on the fin plate, wherein the plurality of surface waveforms are disposed at an angle one another.

In addition to one or more of the above disclosed aspects or as an alternate the method includes directing the gas flow from a trough-side edge of the fin plate to a peak-side edge of the fin plate, wherein the peak-side edge comprises three mutually spaced peaks and the trough-side edge includes three mutually spaced troughs.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
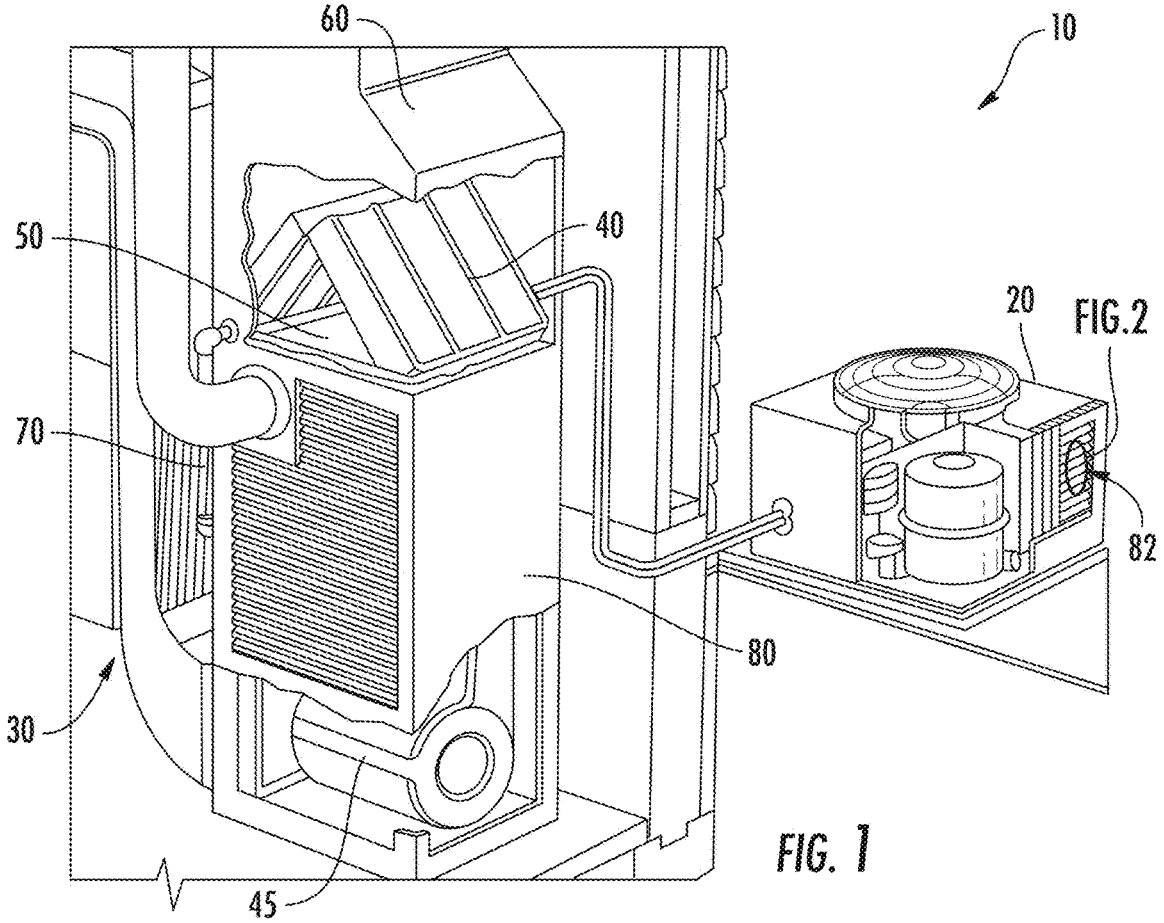
FIG. 1 illustrates an air conditioning system that may be modified to include one or more features of the disclosed embodiments.

FIG. 1 illustrates a typical air conditioning (AC) system 10. The system 10 includes a condenser assembly 20 and an evaporator assembly 30. The evaporator assembly 30, may also be referred to as an air handler, includes evaporator coils (coils) 40, a blower 45, a plenum 60 and evaporator drain lines 70. The coils 40 are disposed over a drip pan 50. The evaporator assembly 30 also includes a housing 80.

Figure 2:
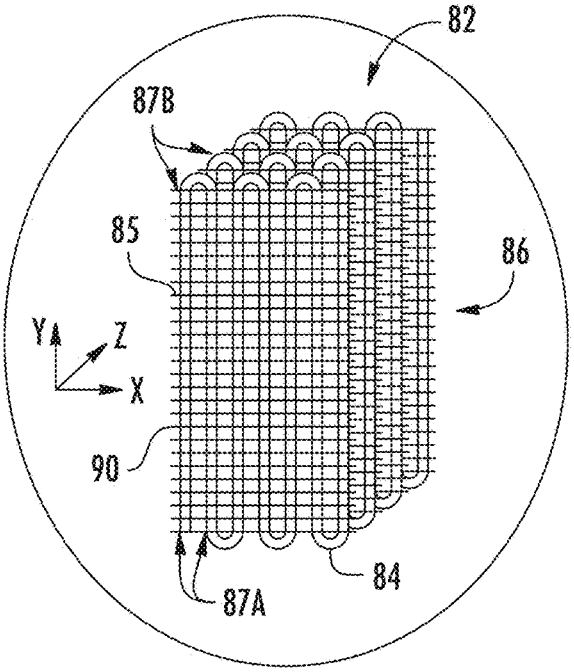
FIG. 2 illustrates a heat exchanger that may be modified to include one or more features of the disclosed embodiments.

The condenser assembly 20 and evaporator assembly 30 may each include a heat exchanger 82, more clearly illustrated in FIG. 2. The heat exchanger 82 may include a tube pack 84 that is intended to carry heated fluid. The tube pack 84 may include a plurality of tube risers 85 that are interconnected and extend in the Y direction. The tube risers 85 may be distributed in riser rows 87A in the X direction and riser columns 87B in the Z direction. FIG. 2, as a non-limiting example, illustrates seven of the riser rows 87A and four of the riser columns 87B to provide twenty-eight of the tube risers 85 in FIG. 3. Of course, the configuration of the tube pack 84 is for illustration purposes only.

Figure 3:
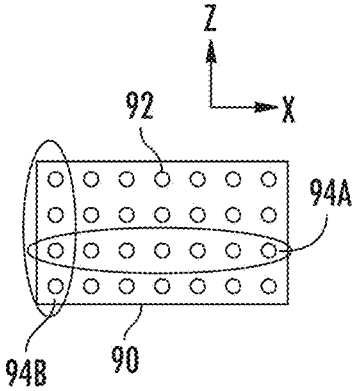
FIG. 3 illustrates a typical fin plate for a heat exchanger.

At least one fin sheet 90 may be connected to the tube pack 84 for dissipating heat. Turning to FIG. 3, each fin sheet 90 may be generally rectangular. The fin sheet 90 is configured in rows 94A and columns 94B to receive the tube risers 85 of the tube pack 84. FIG. 3, as a non-limiting example, illustrates seven of the rows 94A and four of the columns 94B to receive the twenty-eight of the tube risers 85 of the tube pack 84.

With the above typical type of fin sheet 90, airflow about the tube risers 85 may create airflow wakes behind the tube risers 85. This may result in a pressure drop and reduced heat transfer with the tube risers 85.

Figure 4:
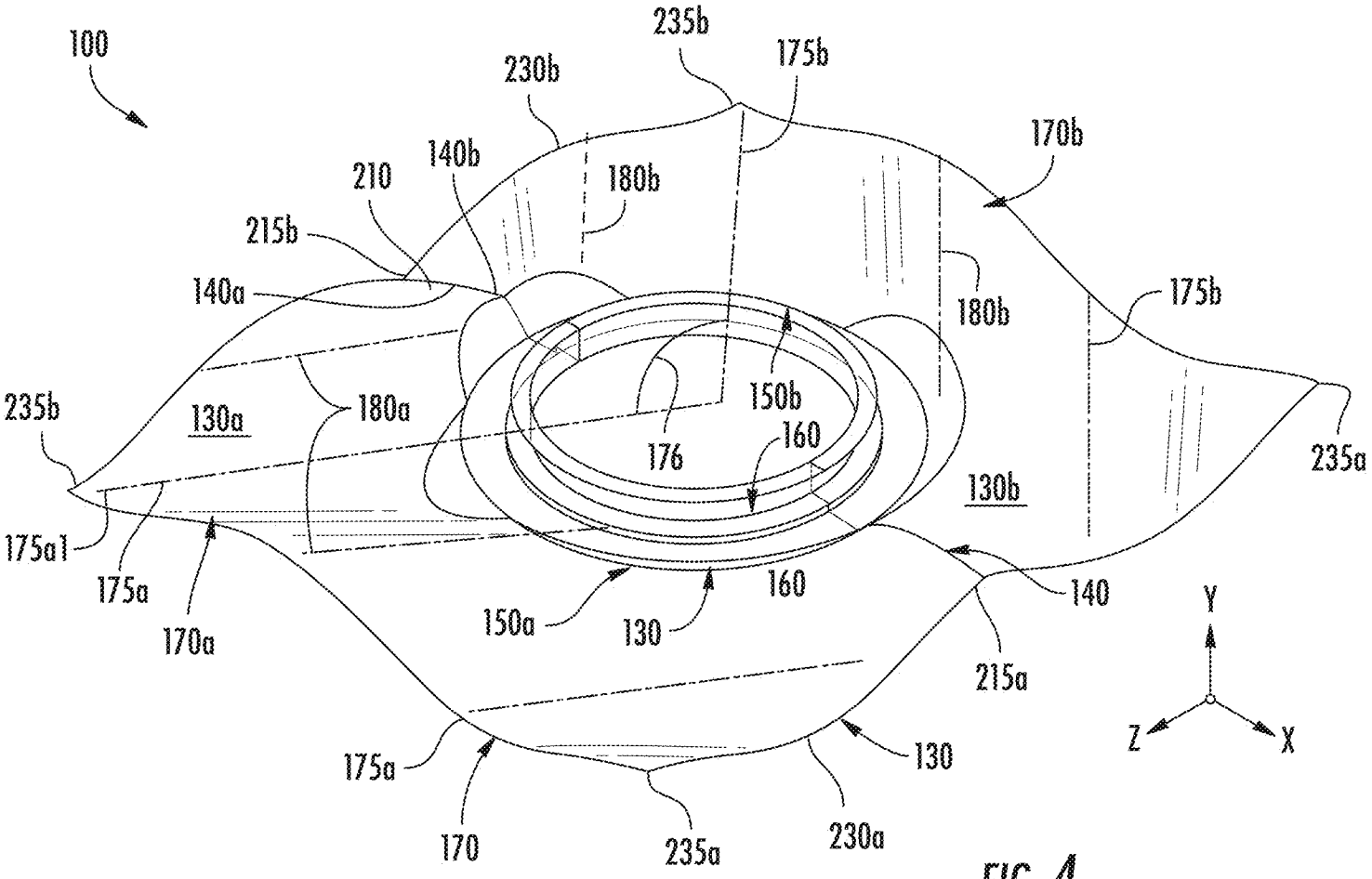
FIG. 4 illustrates a fin plate according to an embodiment.

Turning now to FIG. 4, a fin plate 100 according to an embodiment is disclosed for the heat exchanger 82. The fin plate 100 includes one half-plate 130*a* that is rectangular and has one perimeter edge 140*a* with one cut-out 150*a* that is arcuate. Another half-plate 130*b* is included that is rectangular and has another perimeter edge 140*b* with another cut-out 150*b* that is arcuate. The half-plates are generally referred to as 130, the perimeter edges are generally referred to as 140 and the arcuate cut-outs are generally referred to as 150.

The perimeter edges 140 are connected to one another about a tube connector 160 to form the fin plate 100. The tube connector 160 may also be provided as half sections that are formed each the respective half plate.

One surface waveform 170*a* is formed on the one half-plate 130*a*. Another surface waveform 170*b* is formed on the other half-plate 130*b*. The surface waveforms may be generally referred to as 170. The surface waveforms 170 may be sinusoidal, triangular, trapezoidal, etc. The surface waveforms 170 are disposed at an angle to one another on the fin plate 100. For example, one trough 175*a*1 of the one surface waveform 170*a* may be at an angle 176 to another trough 175*b*1 of the other surface waveform 170*b*. In one embodiment the angle 176 is approximately ninety degrees so that the surface waveforms 170 are mutually perpendicular. A trough from each of the surface waveforms 170 may intersect in the center of the tube connector 160.

Each of the surface waveforms 170 is pitched so that the half-plates 130 each include at least two of the troughs and two peaks. The toughs in the one half-plate 130*a* are generally referenced as 175*a* and the troughs in the other half-plate are generally referenced as 175*b*. The peaks in the one half-plate 130*a* are generally referenced as 180*a* and the peaks in the other half-plate are generally referenced as 180*b*. A height of each of the peaks 180*a* and 180*b* and troughs 175*a* and 175*b* of each of the surface waveforms 170 may be the same. A distance 200 between each of the peaks 180*a* and 180*b* and troughs 175*a* and 175*b* in each of the surface waveforms 170 may be the same.

A fin plate seam 210 is formed where the one perimeter edges 140 abut. The surface waveforms 170 are configured so that except for the cutouts 150, the fin plate seam 210 is a continuous seam. One end 215*a* of the fin plate seam 210 may be along one of the peaks and another end 215*b* of the fin plate seam 210 may be along one of the troughs. That is, the one end 215*a* of the fin plate seam 210 is higher than the other end 215*b* of the fin plate seam 210.

A peak-side edge 230*a* of the fin plate 100 is defined between one pair of corners 235*a* of the fin plate 100 that are adjacent the one end 215*a* of the fin plate seam 210. The one pair of corners 235*b* are also on respective ones of the peaks. Thus, the peak-side edge 230*a* has three mutually spaced peaks or portions of peaks. A trough-side edge 230*b* of the fin plate 100 is defined between another pair of corners 235*b* of the fin plate 100 that are adjacent the other end 215*b* of the fin plate seam 210. The other pair of corners 235*n* are on respective ones of the troughs. Thus, the trough-side edge 230*b* has three mutually spaced troughs or portions of troughs. As can be appreciated, when assembled in a grid of tubes, the corners 235*a* on the peak-side edge 230*a* of the fin plate seam 210 are higher than the corners 235*b* on the trough-side edge 230*b* of the fin plate seam 210.

The above fin plate 100 induces minimized airflow wakes, if any, behind the tube risers 85, in a direction that is downstream with respect to airflow. This results in a minimized, if any, pressure drop and more efficient heat transfer with the tube risers 85.

Figure 5A:
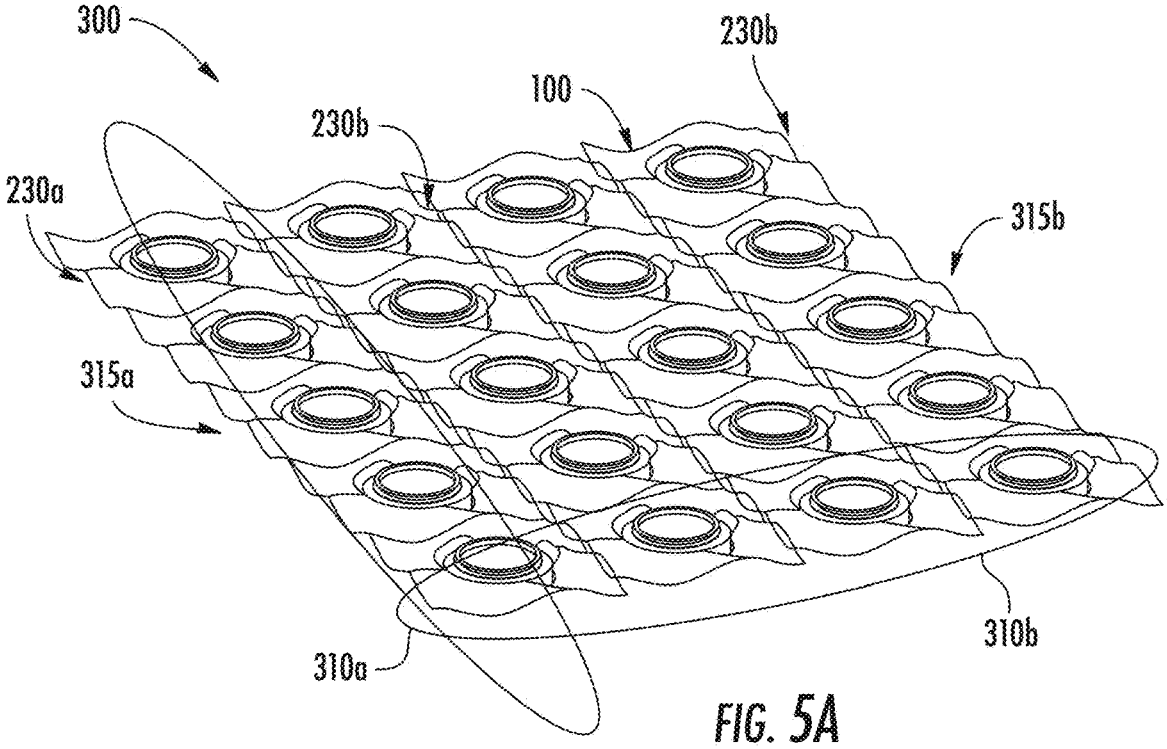
FIGS. 5A-5B illustrate a grid of fin plates according to an embodiment.
Figure 5B:
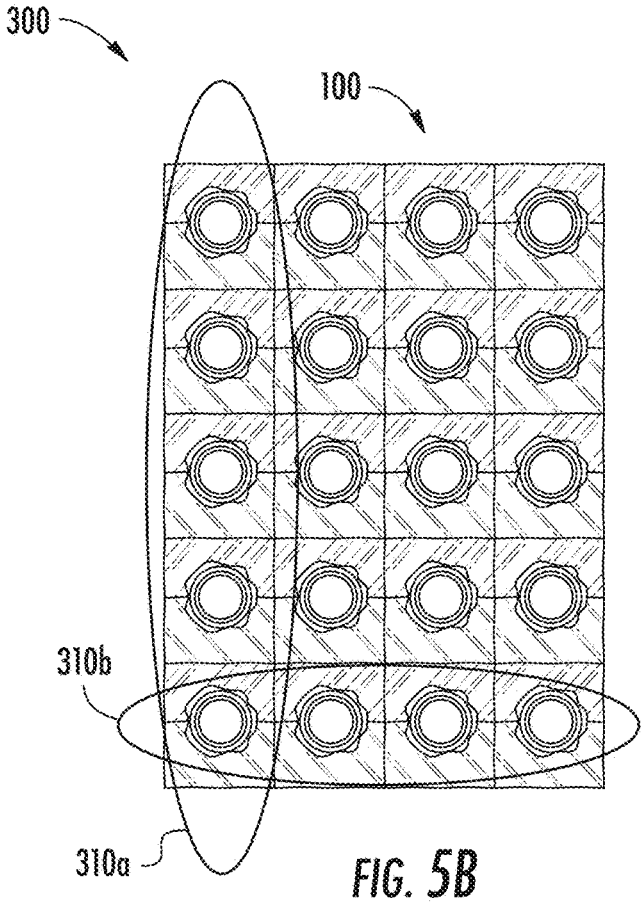

Turning to FIGS. 5A and 5B further disclosed is a system 300 including a plurality of the fin plates 100 arranged in a grid. Aspects of FIGS. 5A and 5B having the same number as FIG. 4 shall be construed the same as FIG. 4. The plurality of the fin plates 100 are arranged in an in-line grid, with a plurality of the fin plates 100 distributed among a plurality of rows 310*a* and columns 310*b*. The plurality of fin plates 100 are arranged so that the peak-side edge 230*a* of each of the fin plates 100 is closer to one side 315*a* of the system 300 and the trough-side edge 230*b* of each of the fin plates 100 is closer to another side 315*b* of the system 300.

Figure 6A:
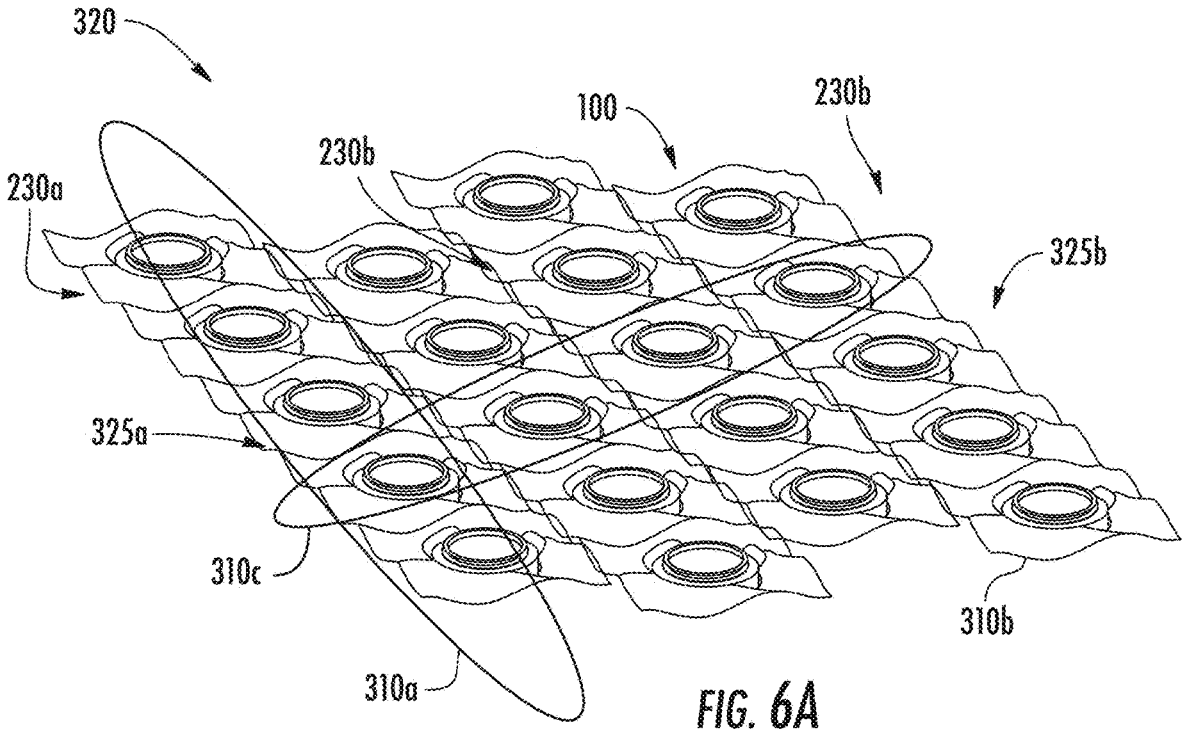
FIGS. 6A-6B illustrate another grid of fin plates according to an embodiment.
Figure 6B:
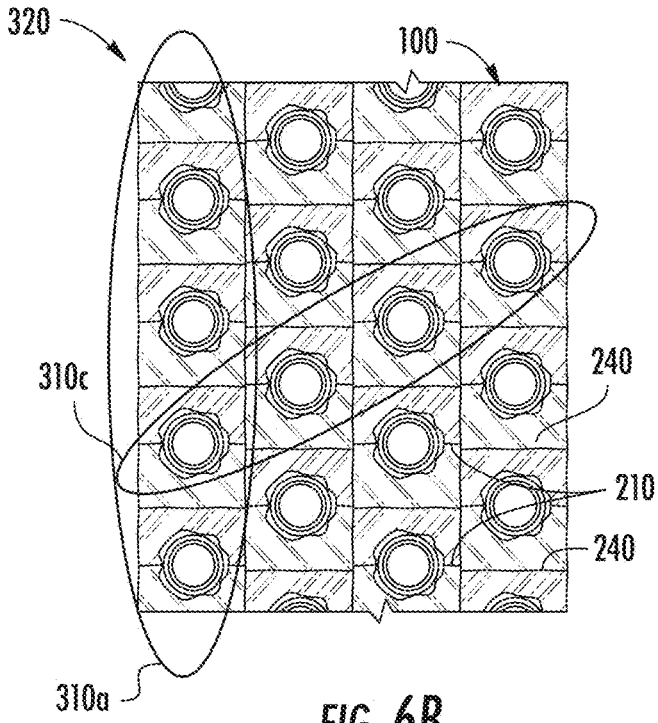

Turning to FIGS. 6A and 6B further disclosed is a system 320 including a plurality of the fin plates 100 arranged in a diagonal-grid. Aspects of FIGS. 6A and 6B having the same number as FIGS. 5A and 5B shall be construed the same as with FIGS. 5A and 5B. A plurality of the fin plates 100 distributed among a plurality of rows 310*a* and angularly-offset columns 310*c*. The result is a staggered grid. The plurality of fin plates 100 are arranged so that the peak-side edge 230*a* of each of the fin plates 100 is closer to one side

325*a* of the system 320 and the trough-side edge 230*b* of each of the fin plates 100 is closer to another side 325*b* of the system 320.

As seen in FIG. 6B, each fin plate 100 includes opposing outside edges 240 extending between the peak-side edge 230*a* and trough-side edge 230*b*. The plurality of the fin plates 100 are arranged so that an fin plate seam 210 of one fin plate 100 is aligned with one of the outside edges 240 of another one of the fin plates 100.

Figure 7:
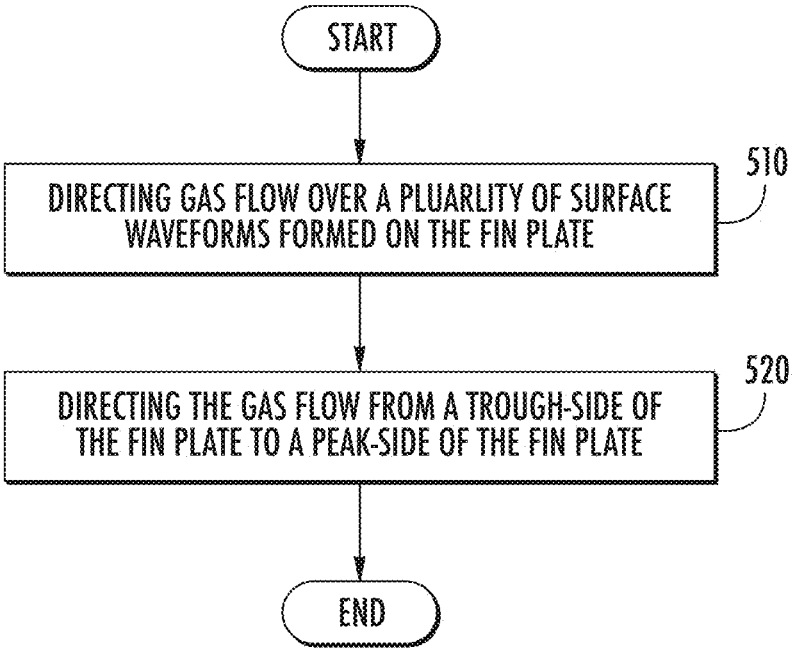
FIG. 7 shows a flow chart illustrating a method of directing air over a fin plate according to an embodiment.

Turning to FIG. 7, a method of directing gas flow over a fin plate 100 that surrounds a tube. As illustrated in block 510 the method includes directing gas (air) flow over a plurality of surface waveforms 170 formed on the fin plate 100. The plurality of surface waveforms 170 are disposed at an angle one another. As illustrated in block 520 the method includes directing the gas flow from a trough-side edge 230*b* of the fin plate 100 to a peak-side edge 230*a* of the fin plate 100. The peak-side edge 230*a* includes opposing corners 235*a* disposed on surface waveform peaks. The trough-side edge 230*b* includes opposing corner 235*b* disposed on surface waveform troughs.

In sum the above disclosure provides a plurality of waves on the either side of a tube, and these waves are at an angle, such as 45 degrees, to the gas (air) flow. This configuration of the wave facilitates the air to flow radially towards the tube, which is the prime heat transfer area. This directed flow reduces a potential wake area of the tube. Thus, pressure drop is reduced and heat transfer capabilities may be enhanced. The configuration of the embodiments is applicable to condenser and evaporator application. It is noted that evaporators tend to work under frosting conditions and the disclosed embodiments are relatively frost tolerant.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A double wave fin plate for a fin-tube heat exchanger, comprising:

one half-plate having one perimeter edge with one cut-out forming one portion of a tube connector;

another half-plate having another perimeter edge with another cut-out forming another portion of the tube connector;

the one perimeter edge and the other perimeter edge are connected to one another about each cut-out to form the fin plate and the tube connector;

one surface waveform is formed on the one half-plate;

another surface waveform is formed on the other half-plate, and the one surface waveform is disposed at an angle to the other surface waveform in the fin plate, wherein:

each surface waveform on each half-plate defines a peak or a trough that converges at a center of the tube connector; and a fin plate seam is formed where the one perimeter edge and the other perimeter edge abut, and one end of the fin plate seam forms the peak or the trough.

2. The fin plate of claim 1, wherein each half-plate is rectangular.

3. The fin plate of claim 1, wherein each tube connector is circular.

4. The fin plate of claim 1, wherein the one surface waveform is perpendicular to the other surface waveform in the fin plate.

5. The fin plate of claim 1, wherein each surface waveform is sinusoidal, triangular, trapezoidal or corrugated.

6. The fin plate of claim 1, wherein:

each surface waveform on each half-plate defines the peak and the trough, wherein:

the one end of the fin plate seam forms the peak; and another end of the fin plate seam forms the trough.

7. The fin plate of claim 6, wherein each of the surface waveforms is pitched so that each half-plate defines a plurality of the peaks and a plurality of the troughs.

8. The fin plate of claim 7, wherein:

a height of each of the plurality of the peaks and each of the plurality of the troughs of each of the surface waveforms is the same; and a distance between each of the plurality of the peaks and each of the plurality of the troughs in each of the surface waveforms is the same.

9. The fin plate of claim 7, wherein:

a peak-side edge of the fin plate is defined between one pair of corners of the fin plate that are adjacent the one end of the fin plate seam; and the one pair of corners are on ones of the plurality of peaks.

10. The fin plate of claim 9, wherein:

a trough-side of the fin plate is defined between another pair of corners of the fin plate that are adjacent the other end of the fin plate seam; and the other pair of corners are on respective ones of the plurality of troughs.

11. A system comprising a plurality of the fin plates of claim 10 arranged in a grid.

12. The system of claim 11, wherein the plurality of fin plates are arranged so that the trough-side edges of each of the fin plates is closer to one side of the system and the peak-side edge of each of the fin plates is closer to another side of the system.

13. The system of claim 11, wherein the plurality of the fin plates are arranged in an in-line grid, with ones of the fin plates distributed among a plurality of rows that are mutually parallel, and a plurality of columns that are mutually parallel, wherein the plurality of rows and the plurality of columns are mutually perpendicular.

14. The system of claim 11, wherein the plurality of the fin plates are arranged on a diagonal grid with ones of the fin plates distributed among a plurality of rows that are mutually parallel, and a plurality of columns that are mutually parallel, wherein the plurality of columns are angled relative to the plurality of rows.

15. The system of claim 11, wherein the fin plate seam of one fin plate is aligned with an outside edge of another fin plate.

16. The system of claim 11, comprising a plurality of tubes distributed among the plurality of fin plates.

17. A method of directing gas flow over the double wave fin plate of claim 1, that surrounds a tube, comprising directing gas flow over a plurality of the surface waveforms formed on the fin plate, wherein the plurality of the surface waveforms are disposed at the angle to one another.

18. The method of claim 17, comprising directing the gas flow from a trough-side edge of the fin plate to a peak-side edge of the fin plate, wherein the peak-side edge comprises a plurality of the peaks and the trough-side edge includes a plurality of the troughs.

19. A double wave fin plate for a fin-tube heat exchanger, comprising:

one half-plate having one perimeter edge with one cut-out forming one portion of a tube connector;

another half-plate having another perimeter edge with another cut-out forming another portion of the tube connector;

the one perimeter edge and the other perimeter edge are connected to one another about each cut-out to form the fin plate and the tube connector;

one surface waveform is formed on the one half-plate;

another surface waveform is formed on the other half-plate, and the one surface waveform is disposed at an angle to the other surface waveform in the fin plate, wherein:

each half-plate is rectangular;

each tube connector is circular;

the one surface waveform is perpendicular to the other surface waveform in the fin plate;

each surface waveform is sinusoidal, triangular, trapezoidal or corrugated;

one peak or one trough from each surface waveform on each half-plate converges at a center of the tube connector;

each of the surface waveforms is pitched so that each half-plate includes at least two peaks and two troughs;

a height of each of the peaks and each of the troughs of each of the surface waveforms is the same;

a distance between each of the peaks and each of the trough in each of the surface waveforms is the same;

a fin plate seam is formed where the one perimeter edge and the other perimeter edge abut; and one end of the fin plate seam forms one of the peaks.

* * * * *